US006764376B2

(12) United States Patent
Agostini et al.

(10) Patent No.: US 6,764,376 B2
(45) Date of Patent: Jul. 20, 2004

(54) SPRING-DRIVEN TOY VEHICLE

(75) Inventors: Matthew Felix Agostini, Philadelphia, PA (US); Mary Ellen Gertrude Fosbenner, Riverton, NJ (US); Gregory John Sisolak, Mount Laurel, NJ (US); William Francis Michael Dougherty, Oakford, PA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/444,220

(22) Filed: May 23, 2003

(65) Prior Publication Data

US 2004/0002286 A1 Jan. 1, 2004

Related U.S. Application Data

(60) Provisional application No. 60/385,437, filed on May 31, 2002.

(51) Int. Cl.[7] ..... A63H 17/26
(52) U.S. Cl. ..... 446/466; 446/469
(58) Field of Search ..... 446/466, 437, 446/465, 460, 469, 431, 448, 457, 463

(56) References Cited

U.S. PATENT DOCUMENTS

| | | | | | |
|---|---|---|---|---|---|
| 3,161,172 | A | | 12/1964 | Kässbohrer | |
| 3,748,780 | A | | 7/1973 | Glass et al. | |
| 3,919,804 | A | | 11/1975 | Nakata | |
| 4,022,290 | A | * | 5/1977 | Boyer | 180/14.1 |
| 4,467,556 | A | | 8/1984 | Iwao | |
| 4,493,671 | A | | 1/1985 | Kennedy et al. | |
| 4,595,097 | A | | 6/1986 | Herstein | |
| 4,602,800 | A | * | 7/1986 | Persson | 280/6.156 |
| 4,683,986 | A | | 8/1987 | Darda et al. | |
| 4,696,655 | A | * | 9/1987 | D'Andrade et al. | 446/466 |
| 4,702,720 | A | | 10/1987 | Konta et al. | |
| 4,850,929 | A | * | 7/1989 | Genevey | 446/466 |
| 5,022,884 | A | | 6/1991 | Hippely et al. | |
| 5,167,563 | A | * | 12/1992 | Saffer | 446/465 |
| 5,374,213 | A | * | 12/1994 | Brovelli | 446/463 |
| 5,411,138 | A | | 5/1995 | Klawiter | |
| 5,527,059 | A | * | 6/1996 | Lee, Jr. | 446/466 |
| 5,549,501 | A | | 8/1996 | Jow | |
| 5,609,510 | A | * | 3/1997 | Stubenfoll et al. | 446/456 |
| 5,766,056 | A | | 6/1998 | Tsai | |
| 5,807,158 | A | | 9/1998 | Tsai | |
| 6,383,054 | B1 | * | 5/2002 | Rauch | 446/456 |
| 6,394,876 | B1 | * | 5/2002 | Ishimoto | 446/428 |
| 6,394,878 | B1 | * | 5/2002 | Wang | 446/469 |
| 6,398,613 | B1 | * | 6/2002 | Rehkemper et al. | 446/197 |
| 6,589,098 | B2 | * | 7/2003 | Lee et al. | 446/465 |
| 6,604,982 | B1 | * | 8/2003 | Croteau-Brooks | 446/466 |

* cited by examiner

*Primary Examiner*—Derris H. Banks
(74) *Attorney, Agent, or Firm*—Akin Gump Strauss Hauer & Feld, LLP.

(57) ABSTRACT

The invention is a spring-driven toy vehicle having front and rear chassis portions, at least one front wheel and at least one rear wheel. The front chassis portion is hingably connected to the rear chassis portion. The chassis portions are capable of a pivotal motion relative to one another from a first undeflected position to a second deflected position. A drive motor is mounted to one of the front and rear chassis portions. The motor contains a motor spring. A drive axle is operably connected with the motor spring. The drive axle is connected to at least one front wheel or one rear wheels to rotate the at least one connected wheel. A rotational coupling is configured to transfer the pivotal motion of the chassis portions relative to one another into a rotational motion to wind the motor spring.

14 Claims, 8 Drawing Sheets

SPRING-DRIVEN TOY VEHICLE

CROSS-REFERENCE TO RELATED APPLICATIONS

This application claims benefit of U.S. Provisional Patent Application 60/385,437, "Spring-Drive Toy Vehicle", filed May 31, 2002, the subject matter of which is incorporated herein by reference.

BACKGROUND OF THE INVENTION

This invention relates to toy wheeled vehicles which have a spring-driven motor and, more particularly, to a toy vehicle with a motor spring which is charged by the user pushing down on the vehicle.

The use of spring-driven motors is well known in the art of toy wheeled vehicles. A variety of mechanisms have been used in the past to charge the motor spring, including wind-up keys and friction wheels. A simple mechanism which uses very simple physical actions to charge the motor would be considered especially advantageous, as such a simple method would allow the toy wheeled vehicle to be played with by children of such tender years as to lack the strength or coordination to manipulate a wind up key or a friction wheel. To the degree that simple charging motions could be accomplished with a simple mechanism, that would be an additional advantage, as simple mechanisms tend to be less expensive to manufacture and are often more rugged and durable in use.

It is also known in the prior art to provide toy wheeled vehicles with suspension mechanisms for the wheels, allowing the wheels to move relative to the vehicle chassis and body. Such suspension systems add realism to the play scenario, allowing the toy wheels to better replicate the operation of the wheels of full-sized vehicles. It is further known in the prior art to provide toys generally with pop-up features, which are particularly intriguing to younger children. The ability to combine a simple spring motor winding mechanism with one or more of these other features should thus be especially attractive.

SUMMARY OF THE INVENTION

The invention is a spring-driven toy vehicle comprising front and rear chassis portions, each with front and rear ends. The front chassis portion supports at least one front wheel at the front end and is hingably connected at the rear end to the front end of the rear chassis portion. The rear chassis portion supports at least one rear wheel at the rear end. The chassis portions are capable of a pivotal motion relative to one another from a first undeflected position to a second deflected position. A drive motor is mounted to one of the front and rear chassis portions. The motor contains a motor spring. A drive axle is operably connected with the motor spring. The drive axle is further operably connected to one of the at least one front and rear wheels to rotate the at least one connected wheel. A rotational coupling between one of the chassis portions and the motor spring is configured to transfer the pivotal motion of the chassis portions relative to one another into a rotational motion to wind the motor spring.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
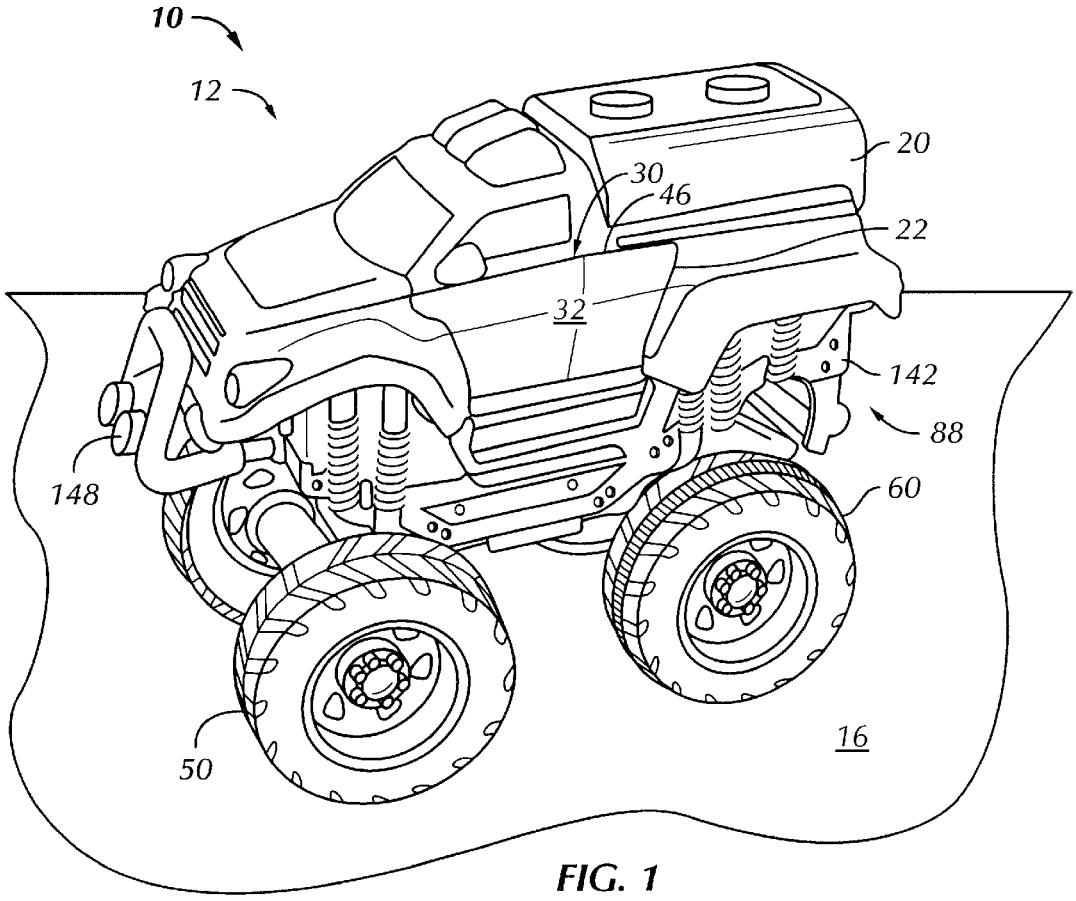
FIG. 1 is a left side perspective view of a spring-driven toy vehicle, shown in an undeflected position, in accordance with a preferred embodiment of the present invention.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the toy vehicle and designated parts thereof. The terminology includes the words above specifically mentioned, derivatives thereof and words of similar import.

Figure 2:
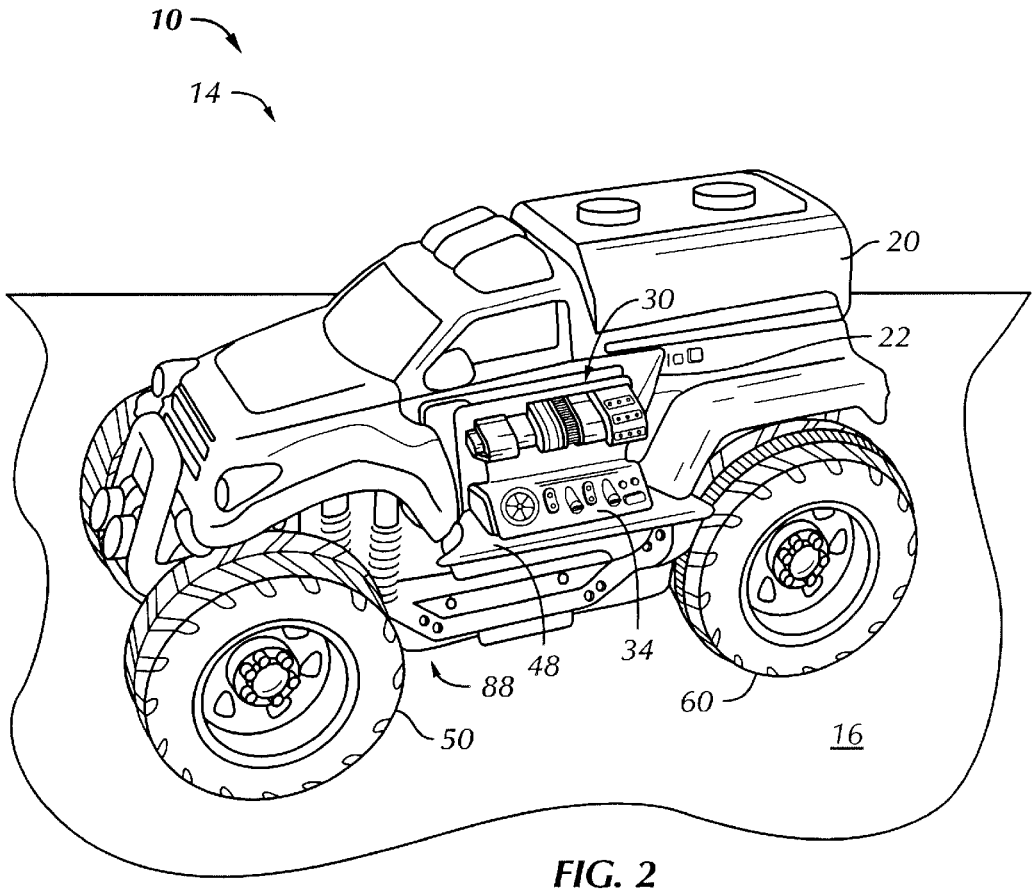
FIG. 2 is a left side perspective view of the toy vehicle of FIG. 1, with the toy vehicle shown in a deflected position.

Referring to the figures, wherein like numerals are used to indicate like elements throughout, there is shown in FIGS. 1–7, a preferred embodiment of a spring-driven toy vehicle in accordance with the present invention. The toy vehicle 10 includes a chassis assembly 88, a vehicle body portion 20, a pair of front wheels 50 and a pair of rear wheels 60. In FIG. 1, the toy vehicle 10 is shown in a first, undeflected position 12. As seen in FIG. 2, under the action of a user pushing down on the vehicle body 20, the toy vehicle 10 may assume a second, deflected position 14. In this deflected position 14, the toy vehicle 10 is pushed down closer to a supporting surface 16 and the front wheels 50 and the rear wheels 60 are pushed farther apart in a longitudinal direction, lengthening a wheelbase of the toy vehicle 10. The toy vehicle 10 is equipped with a pop-up door assembly 30. In the undeflected position 12, the pop-up door assembly 30 is in a first, closed position 46. When the toy vehicle 10 is in its deflected position 14, the pop-up door assembly 30 is caused to move from the first, closed position 46 to a second, deployed or display position 48.

Figure 3:
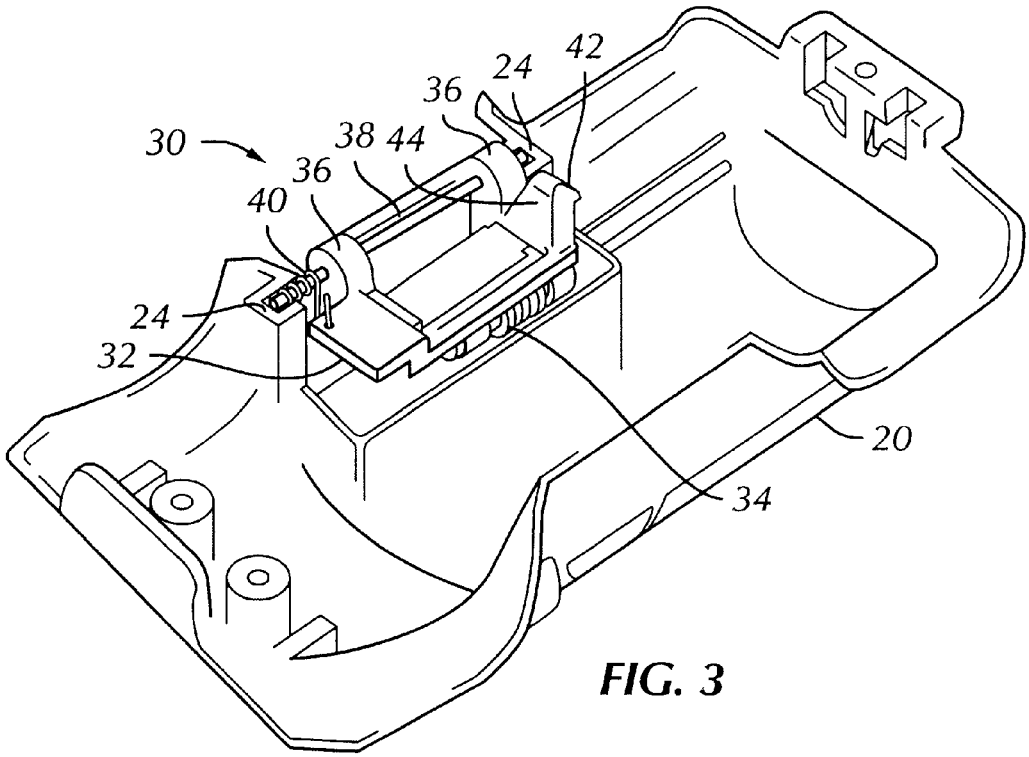
FIG. 3 is a side perspective view of an interior surface of a vehicle body portion of the toy vehicle of FIG. 1.

As seen particularly in FIGS. 1–3, the pop-up door assembly 30 comprises a generally L-shaped door 32. When in the closed position 46, the door 32 fits within a door opening 22 of the vehicle body 20. A decorative accessory 34 may be attached to or made integral with an interior portion of the door 32 such that the decorative accessory 34 is displayed when the door assembly 30 is in the deployed position 48. In this first preferred embodiment, the decorative accessory is made to resemble a fire hose. Referring specifically to FIG. 3, the pop-up door assembly 30 further includes a torsion spring 40 and a door pivot shaft 38. The door 32 is pivotally mounted to the door pivot shaft 38 by two door mounting collars 36. The ends of the door pivot shaft 38 are slidably received in receptacles 24 molded into the vehicle body 20. The door 32 also includes a protrusion 42 which extends downward when the door 32 is in its closed position 46 and the vehicle body 20 is in a normal upright position. The protrusion 42 includes a camming surface 44.

Figure 4:
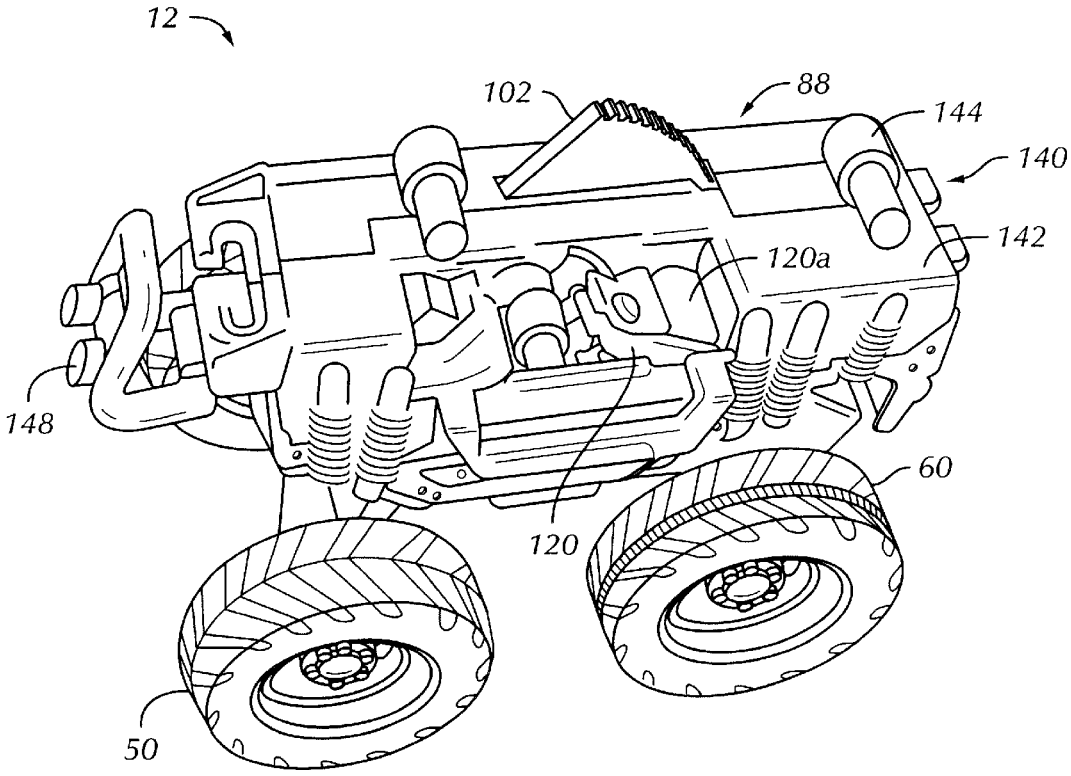
FIG. 4 is a left side perspective view of the toy vehicle of FIG. 1, shown with the vehicle body portion removed.
Figure 5:
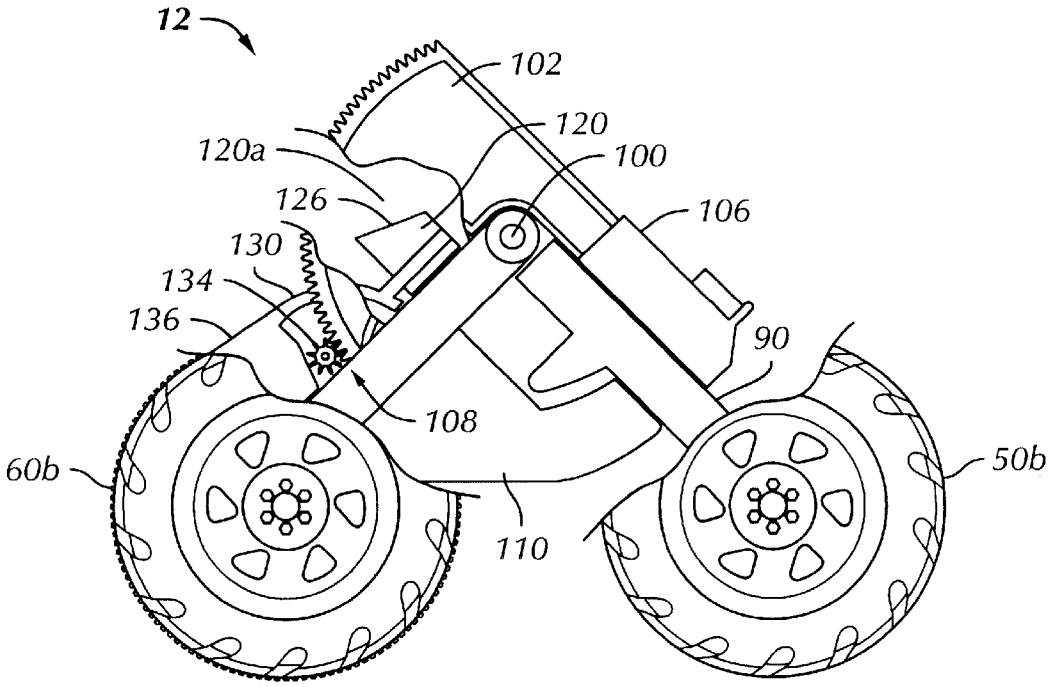
FIG. 5 is a right side elevational view of the toy vehicle of FIG. 4, shown with left and right housing plates removed and shown in the undeflected position.
Figure 6:
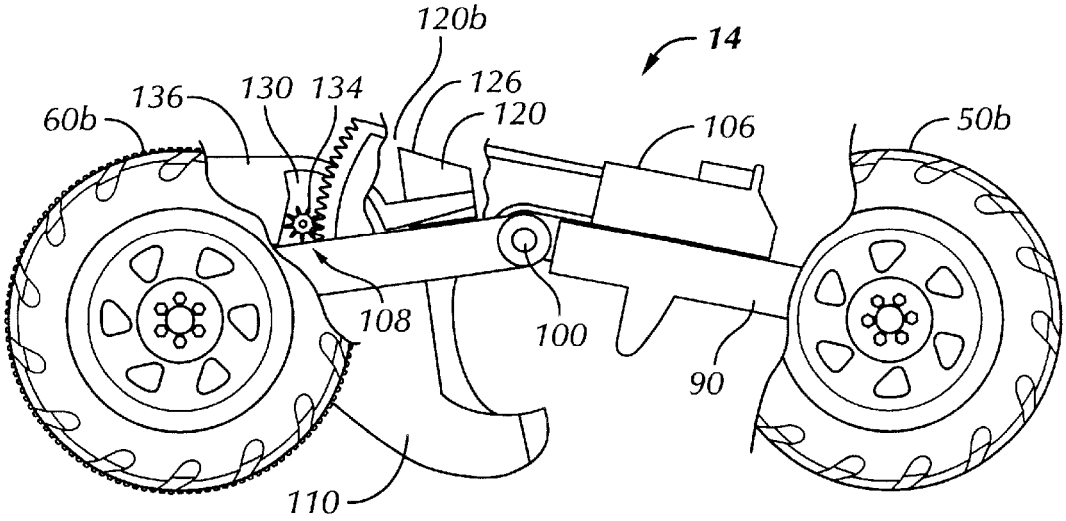
FIG. 6 is a right side elevational view of the toy vehicle of FIG. 5, shown in the deflected position.
Figure 7:
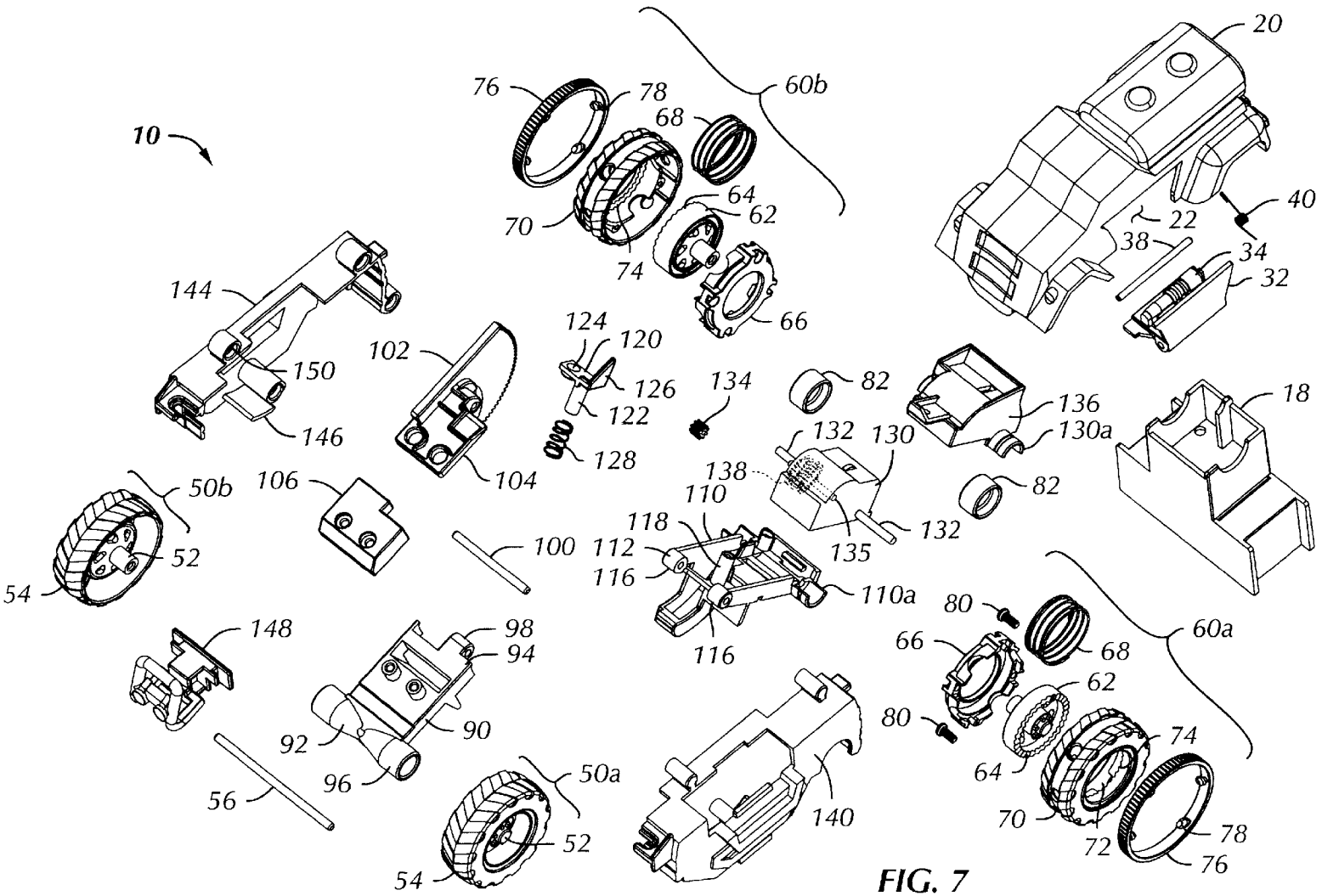
FIG. 7 is an exploded assembly view drawing of the toy vehicle of FIG. 1.

With reference now to FIG. 4, the chassis assembly 88 includes an upper housing 140 formed by a left side housing 142 and a right side housing 144. A bumper 148 attaches to the side housings 142, 144. With the vehicle body 20, side housings 142, 144 and bumper 148 removed, the toy vehicle 10 appears as seen in FIG. 5. The toy vehicle 10 includes a front chassis portion 90 and a rear chassis portion 110. With reference to FIGS. 5 and 7, the front chassis portion 90 has a front end 92 and a rear end 94. Likewise, the rear chassis portion 110 has a front end 112 and a rear end 114. The front wheels 50 connect to the front chassis portion 90 at the front end 92 with an axle 56. The rear end 94 of the front chassis portion 90 hingedly connects to the front end 112 of the rear chassis portion 110 by a pivot axle 100. The front chassis portion 90 is provided with an axle collar 98 and the rear chassis portion 110 is similarly provided with mating axle collars 116. The pivot axle 100 is inserted within the collars 98 and 116 to form a hinge joint. The outer ends of axle 100 are captured in journals 150 on the inner sides of the left and right chassis housings 142, 144, thus fixing the position of upper housing 140 relative to the front and rear chassis portions 90, while allowing the front and rear chassis portions 90 to rotate relative to the upper housing 140. The rear wheels 60 connect to the rear chassis portion 110 at the rear end 114 of the rear chassis portion 110.

A sector gear 102 is affixed to the front chassis portion 90 by a gear support plate 104 captured between a sector gear mounting plate 106 and the front chassis portion 90. The rear chassis portion 110 supports a spring motor 130, which is affixed to the rear chassis portion 110 with a motor cover plate 136. A pinion gear 134 is mounted on a side of the spring motor 130. The spring motor 130 is preferably a commercially available motor, e.g. a model C2101 [0.18×6×(180+45)] from Seikoken (Thailand) Company Ltd., Northern Region Industrial Estate 101 M00 4, Tambol Banklang, Amphur Muang, Lamphun 51000, Thailand. This company is a subsidiary of the Seikoken Group, 27-7,2-Chome, Ayase, Adachi-Ku, Tokyo 120, Japan. The spring motor 130 also includes a drive axle 132, which connects to the rear wheels 60. The pinion gear 134 is mounted to one end of a shaft 135 directly coupled with the motor spring 138 (in phantom). Motor spring 138 winds around shaft 135. Shaft 135 also supports on an opposite side of the motor spring 138 from the pinion gear 134 a combination input/output gear, the two portions of which connect with parallel input and output gear trains between the combination gear and the drive shaft 132. Slip gears in the motor gear trains permit the motor spring 138 to be charged (i.e. wound) by rotation of the pinion gear 134 without causing rotation of the rear drive wheels 60. This decoupling of the drive axle 132 from the motor spring 138 permits the toy vehicle 10 to be held stationary while it is being pressed down. The operative combination of the sector gear 102 and the pinion gear 134 in conjunction with the pivoting motion of the front chassis portion 90 relative to the rear chassis portion 110 in moving from the undeflected position 12 to the deflected position 14 thus forms a rotational coupling 108.

The spring motor 130 may be wound in one of either of two ways. First, if user pushes down on the toy vehicle 10, the front and rear chassis portions 90, 110 pivot with respect to one another and with respect to the left and right housings 142, 144. The rear end 94 of the front chassis portion 90 and the front end 112 of the rear chassis portion 110 and the pivot between those ends all move downward, while the front end 92 of the front chassis portion 90 and the rear end 114 of the rear chassis portion 110 both move longitudinally outward. Accordingly, the front and rear wheels 50, 60 move farther away from each other in the longitudinal direction, and also move closer to the vehicle body 20. The sector gear 102 engages with the pinion gear 134 of the spring motor 130. As the sector gear 102 rotates with respect to the rear chassis portion 110, the pinion gear 134 is rotated by the sector gear 102. The motor spring 138 inside the spring motor 130 is charged by this rotation of the pinion gear 134. Second, the motor spring 138 can be charged by rotation of the drive axle 132. Specifically, if the rear wheels 60 and drive axle 132 are rotated in a direction corresponding to rearward motion of the toy vehicle 10, the motor spring 138 is charged. A clutch mechanism of the rear wheels 60 described below prevents the spring motor 130 from being overcharged when being wound by rearward rotation of the rear wheels 60. Alternatively, either the front or rear chassis portions 90, 110 can be pivoted with respect to the upper housing 140. This will cause a partial rotation of the sector gear 102 and the pinion gear 134 with respect to one another. This can be done by pushing down on the vehicle 10 at only one end or by lifting the vehicle 10 and squeezing together one of the chassis portions 90, 110 and the upper housing 140/vehicle body 20.

The embodiment shown includes two rear wheels 60, a left rear wheel 60*a* and a right rear wheel 60*b*. Each rear wheel 60 includes a number of components, including a center hub 62 attached to the drive axle 132 and having a first toothed circumferential surface 64. The rear wheels 60 further include an interior hub 66 and a tire 70. The interior hub 66 and the tire 70 are rigidly attached via a plurality of screws 80. The tire 70 has a circular opening 72 with a second toothed surface 74 disposed circumferentially about an interior portion of the opening 72. Upon assembly, the first toothed surface 64 mates with the second toothed surface 74 to form a slip-type clutch mechanism. More specifically, the first toothed surface 64 is biased into releasable engagement with the second toothed surface 74 by a spring 68 captured between the interior hub 66 and the center hub. Thus, the center hub 62 and tire 70 are not rigidly connected, but rather may rotate relative to one another if a force to move the first and second toothed surfaces 64, 74 out of engagement (that is, a force sufficient to overcome the force of the spring 68) is applied.

Each of the rear wheels 60 further includes an elastomeric traction ring 76. The traction rings 76 fit within a central groove formed in an outer ground-contacting surface of the tires 70. The traction rings 76 are attached to the tires 70 by pins 78 which fit within corresponding receptacles disposed within the ring grooves.

When the toy vehicle 10 is assembled, assembly rings 82 fit over an upper half-cylinder portion 136*a* extending from the motor cover plate 136 and a lower half-cylinder portion 110*a* extending from the rear chassis portion 110. The portions 136*a*, 110*a* mate together upon assembly and the cylinder thus formed is captured within the assembly rings 82 to secure the motor cover plate 136 to the rear chassis portion 110, with the spring motor 130 captured therebetween.

The embodiment shown further includes two front wheels 50, a left front wheel 50*a* and a right front wheel 50*b*. Each front wheel 50 includes a front hub 52 and a front tire 54. The front wheels 50 attach to the front end 92 of the front chassis portion 90 with a front axle 56 which fits within a front axle housing 96.

As seen in FIGS. 4–7, a door opening lever 120 is mounted between the rear chassis portion 110 and the motor cover plate 136. The lever 120 includes a post portion 122, a camming surface 126 and a hole 124 through which the lever 120 mounts to a post 118 molded into the rear chassis portion 110. The lever 120 is biased in an upward position by a coil spring 128. When the front and rear chassis portions 90, 110 are in the undeflected position 12 (see particularly FIGS. 4 and 5), the lever 120 is in a first unextended position 120*a*. When the front and rear chassis portions 90, 110 are moved to the deflected position 14 (see FIG. 6), the lever 120 moves with the rear chassis portion 110 into a second extended position 120*b*. In moving from the first unextended position 120*a* to the second extended position 120*b*, the camming surface 126 engages the door protrusion camming surface 44 to pivot the door 32 from the closed position 46 to the deployed position 48.

With a few exceptions, the components of the toy vehicle 10 are preferably formed from ABS plastic using injection molding techniques well known to those skilled in the art. The exceptions include: the sector gear 102 (preferably fabricated from linear polyoxymethylene-type acetal resin); the door spring 40, the wheel spring 68 and the door opening lever spring 128 (all preferably fabricated from piano wire); the front and rear tires 54, 70 (preferably fabricated from styrene-butadiene-styrene polymer); the door pivot shaft 38, front axle 56 and chassis pivot shaft 100 (all preferably fabricated from steel); the pinion gear 30 (preferably fabricated from copper); and the decorative bumper 148 and a stand 18 (included in the toy vehicle 10 packaging and described in detail herein below) (both preferably formed from polypropylene copolymer plastic). All polymeric components are preferably fabricated using injection molding techniques well known to those skilled in the art. The metal components are fabricated using metal forming techniques well known to those skilled in the art. From this disclosure, it would be obvious to one skilled in the art to substitute other materials (for example, metal or other types of plastic) or other fabrication techniques (for example, machining or stamping) for the materials and fabrication techniques used in the preferred embodiment. Furthermore, from this disclosure it would also be obvious to one skilled in the art to substitute other relative proportions (for example, a toy vehicle which is larger or smaller) for the proportions disclosed herein.

In operation, as described above the spring motor 130 may be charged either when a user pushes down on the top or either end of the toy vehicle 10 or when the rear wheels 60 are rotated in a direction corresponding to rearward motion of the toy vehicle 10. Also as is described above, pushing down on the top of the toy vehicle 10 causes the pop-up door assembly 30 to move from the first closed position 46 to the second displayed position 48 as a result of engagement of the door opening lever 120 upon the door protrusion camming surface 44.

When the user releases the toy vehicle 10, the front and rear chassis portions 90, 110, under the action of the motor spring 138, return to their starting positions as the motor spring 138 relaxes. The charged motor spring 138 of the spring motor 130 operates through a gear train (not shown) internal to the spring motor 130 to cause rotation of the drive axle 132. The rear wheels 60 are thus rotated, causing the toy vehicle 10 to be propelled forward. As the rear chassis portion 110 returns to its normal undeflected position 12, the door opening lever 120 also returns to its unextended position 120*b*, releasing the pop-up door assembly 30. The pop-up door assembly 30 thus also returns to its normal, closed position 46 under the action of the door torsion spring 40.

A bottom arcuate segment 146 on the right housing 144 and a similar arcuate segment (not shown) on the left housing 140 help prevent a user from accessing the area below the front and rear chassis portions 90, 110, as motion between the front and rear chassis portions 90, 110 in this area could create a pinch hazard. The left housing 142 includes an even longer bottom arcuate segment (not seen) cooperating with segment 146 to cover the space beneath and between the front and rear chassis portions 90, 110. The arcuate segments 146 further act as rotational stops and prevent the rotation of one chassis portion 90, 110 if the other portion 110, 90 is pivoted up towards the upper housing 140 and body portion 20.

Prior to purchase, the toy vehicle 10 will be displayed for sale resting on the stand 18 (see FIG. 7). A potential customer will be able to press down on the toy vehicle 10 displayed on the stand 18, and observe operation of the pop-up door assembly 30, the motion of the wheels 50 and 60 relative to the vehicle body 20, and the rotation of the rear wheels 60 under the action of the spring motor 130.

The spring-driven toy vehicle 10 thus combines four highly advantageous elements: very simple motions to charge the spring motor 130; a simple motor spring 138 charging mechanism comprised of the pivotal chassis portions 90 and 110, the sector gear 102, and the pinion gear 134; wheels 50 and 60 which are movable with respect to the vehicle body 20, as to simulate the suspension system of a full-size vehicle; and a pop-up door assembly 30. It is believed that ease of operation, simplicity and ruggedness of the drive mechanism, realism of the invention resulting from movement of the wheels relative to the vehicle body, and engaging play activity resulting from the pop-up door are factors which will lead to commercial success of the device.

Figure 8A:
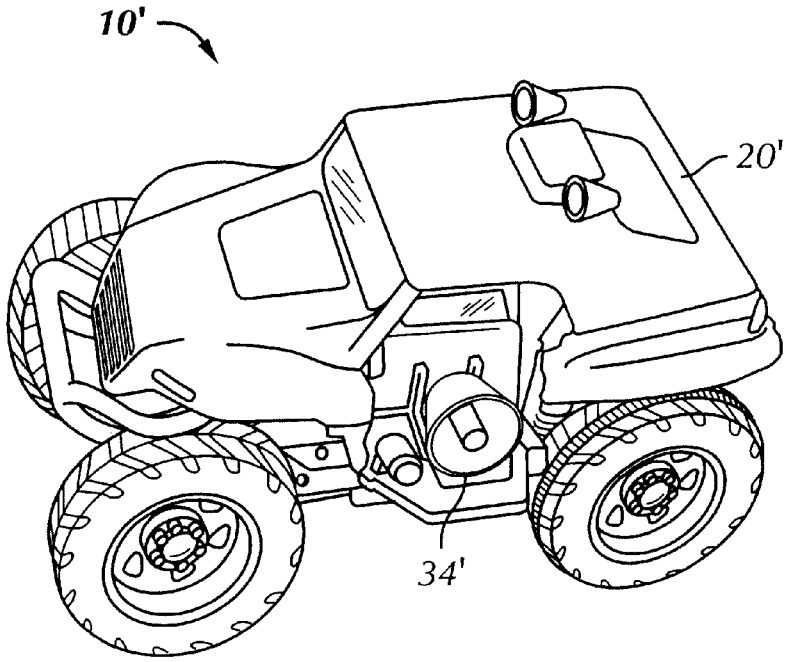
FIG. 8(*a*) and FIG. 8(*b*) are side perspective views of alternate body styles which may be substituted for the body style shown in FIG. 1.
Figure 8B:
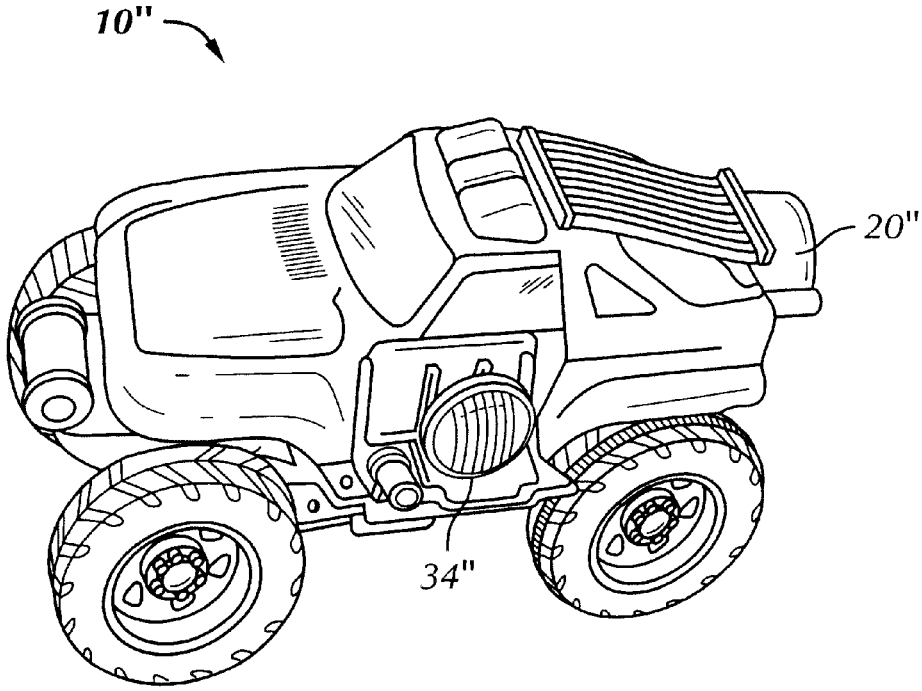

In the embodiment shown, the vehicle body 20 replicates an emergency fire vehicle. From this disclosure, the artisan would recognize that the toy vehicle 10 could be made to replicate a wide range of vehicles, for example other types of emergency response vehicles (including police vehicles, ambulances and rescue team vehicles), passenger vehicles, racing vehicles, motorcycles or airplanes. Indeed, a figurine of virtually any configuration could be disposed on the vehicle chassis assembly 88. For example, FIG. 8A illustrates a dune buggy emergency vehicle 10' having a dune buggy vehicle body 20' disposed on the chassis assembly 88. In the dune buggy 10' embodiment, the door decorative accessory 34' is made to resemble a spotlight. FIG. 8B illustrates a police emergency vehicle 10" having a police vehicle body 20" disposed on the chassis assembly 88. In the police vehicle 10" embodiment, the decorative accessory 34" resembles a megaphone.

It will be appreciated by those skilled in the art that changes could be made to the embodiments described above without departing from the broad inventive concept thereof, especially different pop-up/pop-out mechanisms and accessories. Also, the locations of the spring motor 130 and sector gear 102 could be reversed and front wheels 50 driven rather than the rear wheels 60. Furthermore, the upper housing 140 can be configured to be the outer body of the toy vehicle 10.

It is understood, therefore, that this invention is not limited to the particular embodiments disclosed, but it is intended to cover modifications within the spirit and scope of the present invention.

We claim:

1. A spring-driven toy vehicle comprising:

front and rear chassis portions, each with front and rear ends;

the front chassis portion supporting at least one front wheel at the front end and hingably connected at the rear end to the front end of the rear chassis portion;

the rear chassis portion supporting at least one rear wheel at the rear end;

the chassis portions coupled together by a pivot shaft and being capable of a pivotal motion relative to one another from a first undeflected position to a second deflected position;

a drive motor mounted to one of the front and rear chassis portions, the motor containing a motor spring;

a drive axle operably connected with the motor spring, the drive axle further being operably connected to one of the at least one front and rear wheels to rotate the at least one connected wheel;

a rotational coupling between one of the chassis portions and the motor spring configured to transfer the pivotal motion of the chassis portions relative to one another into a rotational motion to wind the motor spring.

2. The spring-driven toy vehicle of claim 1, wherein the motor spring biases the front and rear chassis portions into the undeflected position and wherein the front and rear chassis portions may be moved from the undeflected position to the deflected position by a user pressing down upon the toy vehicle.

3. The spring-driven toy vehicle of claim 2, wherein when the user releases the toy vehicle, the motor spring urges the front and rear chassis portions to return to the undeflected position, and the spring motor propels the toy vehicle forward.

4. The spring-driven toy vehicle of claim 1, wherein the motor spring is wound by rotation of the drive axle in a direction corresponding to rearward motion of the toy vehicle.

5. The spring-driven toy vehicle of claim 4, wherein the drive axle is operatively coupled to the motor and the motor spring is wound by rotation of the at least one wheel connected to the drive axle in a direction corresponding to rearward motion of the toy vehicle.

6. The spring-driven toy vehicle of claim 1, further comprising:

a vehicle body supported by the front and rear chassis portions;

a body component being pivotally coupled with a remainder of the vehicle body, the body component having a first closed position and a second deployed position;

a spring biasing the body component into the closed position; and a lever coupled with at least one of the front and rear chassis portions so as to contact the body component and move the body component between the first closed position and the second deployed position as the chassis portions move between the first undeflected position and the second deflected position.

7. The spring-driven toy vehicle of claim 6, wherein when the user presses down against the vehicle body, the at least one front and rear wheels move farther apart, charging the motor spring, moving the vehicle body downward and causing the body component to be moved by the lever from the closed position to the deployed position.

8. The spring-driven toy vehicle of claim 7, wherein when the user releases the vehicle body, the spring urges the body component to the closed position, the motor spring urges the front and rear chassis portions to return to the undeflected position, and the spring motor propels the toy vehicle forward.

9. The spring-driven toy vehicle of claim 1, wherein the motor is attached to the second chassis portion and wherein the rotational coupling comprises a sector gear rigidly attached to the first chassis portion and a pinion gear coupled with the motor spring of the drive motor, teeth of the sector gear being engaged with teeth of the pinion gear and rotation of the pinion gear causing the motor spring to be charged.

10. The spring-driven vehicle of claim 9 wherein the pinion gear is mounted on a shaft about which the motor spring winds.

11. The toy vehicle of claim 1 wherein the drive axle is decoupled from the motor spring as the motor spring is charged by a pinion gear.

12. The spring-driven toy vehicle of claim 1, wherein the toy vehicle imitates a vehicle with oversized tires.

13. The spring-driven vehicle of claim 1, wherein the toy vehicle imitates a vehicle with high ground clearance.

14. The spring-driven vehicle of claim 1, wherein the vehicle body imitates an emergency vehicle.

* * * * *